US006575506B2

(12) United States Patent
Hayakawa et al.

(10) Patent No.: US 6,575,506 B2
(45) Date of Patent: Jun. 10, 2003

(54) DOOR LOCK SYSTEM FOR VEHICLE

(75) Inventors: Shigeru Hayakawa, Chiryu (JP); Hiroshi Ban, Kariya (JP); Norio Konomoto, Nagoya (JP); Katsutoshi Fukunaga, Chiryu (JP); Makoto Suzumura, Kariya (JP); Akira Muramatsu, Chiryu (JP); Yasuhiko Sono, Hekinan (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/809,051

(22) Filed: Mar. 16, 2001

(65) Prior Publication Data

US 2001/0033082 A1 Oct. 25, 2001

(30) Foreign Application Priority Data

Mar. 17, 2000 (JP) ..... 2000-076499

(51) Int. Cl.[7] ..... E05C 3/06
(52) U.S. Cl. ..... 292/216; 292/DIG. 23
(58) Field of Search ..... 292/216, 201, 292/DIG. 23; 70/264

(56) References Cited

U.S. PATENT DOCUMENTS 3,999,791 A * 12/1976 Torii ..... 292/216
4,045,064 A * 8/1977 Okada ..... 292/125
4,986,579 A * 1/1991 Ishikawa ..... 292/201
5,427,421 A * 6/1995 Hamagachi ..... 292/216
5,531,488 A * 7/1996 Yoshikawa ..... 292/216
5,984,384 A * 11/1999 Hamaguchi ..... 292/216

FOREIGN PATENT DOCUMENTS

| | | |
|---|---|---|
| GB | 2 329 927 A | 4/1999 |
| GB | 2 349 171 A | 10/2000 |
| GB | 2 350 644 A | 12/2000 |
| JP | 7-103735 | 11/1995 |

* cited by examiner

*Primary Examiner*—Gary Estremsky
(74) *Attorney, Agent, or Firm*—Burns, Doane, Swecker & Mathis, LLP

(57) ABSTRACT

A door lock system for a vehicle includes a latch mechanism, an open link, an inside lever and a cancel lever. The latch mechanism is adapted to a vehicle door and latches the vehicle door to a vehicle body. The open link is engagable and disengagable with the latch mechanism. The inside lever is adapted to an inside handle of the vehicle door and is engagable with the open link. The cancel lever is connected to the open link and is arranged between the inside lever and the open link so as to be engagable with the inside lever when the open link is disengaged from the latch mechanism.

18 Claims, 12 Drawing Sheets

DOOR LOCK SYSTEM FOR VEHICLE

This application is based on and claims priority under 35 U.S.C. §119 with respect to Japanese Patent Application No. 2000-076499 filed on Mar. 17, 2000, the entire contents of which is incorporated herein by reference.

BACKGROUND OF THE INVENTION

1. Field of the Invention

This invention relates to a door lock system for a vehicle.

2. Description of Related Arts

A type of door lock system for a vehicle is proposed in a Japanese Patent Publication H7-103735 published on Nov. 8, 1995. The door lock system for the vehicle comprises a) a latch mechanism including a latch which is provided in a vehicle door and which engages a striker secured to a vehicle body, and b) a link mechanism including a open link and an electric actuator member for selectively locking or unlocking the engagement between the latch and the striker. The open link is engagable and disengagable with the latch mechanism due to the electric actuator member. Therefore, the engagement between the latch and the striker selectively locks or unlocks the latch.

One type of the door lock system for the vehicle has a function mode which is called a "one motion operation". The one motion operation simultaneously provides a canceling operation to cancel the locked state and an opening operation to enable the door to open. The canceling operation unlocks the latch mechanism by operating an inside handle which is disposed inside the vehicle at the driver's seat side. The opening operation releases the engagement of the latch mechanism so that the door can be opened.

The link mechanism, for the type of door lock system which has the one motion operation mode, includes a safety lever arranged among the inside lever, a cancel lever and the latch mechanism. The inside lever is connected to the inside handle and is connected to the safety lever. The cancel lever is arranged between the safety lever and the open link to be engagable with the open link when the open link disengages with the latch mechanism. When the inside lever rotates, the safety lever rotates the cancel lever and engages the latch mechanism. Therefore, both the canceling operation and the opening operation are operated substantially at the same time by opening the door using the inside handle. Thus, momentary large operation force is necessary in order to open the door using the inside handle.

SUMMARY OF THE INVENTION

It is, therefore, necessary for a door lock system to address at least the foregoing drawbacks of the related art.

According to the present invention, the door lock system for a vehicle includes a) a latch mechanism which is adapted to a vehicle door and which holds or latches the vehicle door to a vehicle body, b) an open link which is engagable and disengagable with the latch mechanism, c) an inside lever which is adapted to an inside handle of the vehicle door and which is engagable with the open link and d) a cancel lever which is connected to the open link and which is arranged between the inside lever and the open link to be engagable with the inside lever when the open link is disengaged from the latch mechanism.

BRIEF DESCRIPTION OF THE DRAWINGS

These and other objects of the invention will become more apparent from the following embodiments of the invention with reference to the attached drawings in which.

DESCRIPTION OF THE PREFERRED EMBODIMENT

An embodiment of this invention will be described below referring to FIGS. 1–8. Each direction of the arrows in FIG. 1 indicates longitudinal, vertical and width directions of the vehicle.

Figure 4:
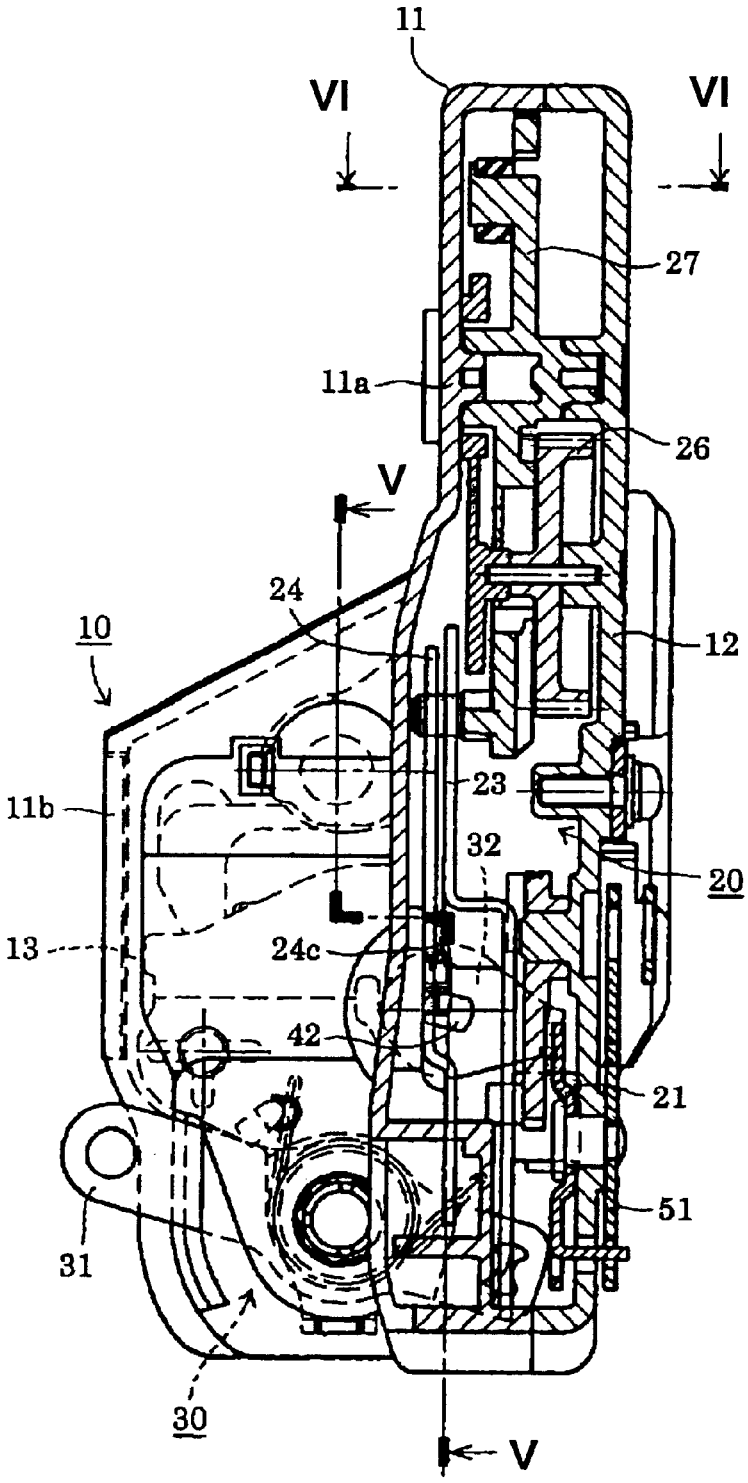
FIG. 4 shows a vertical cross-sectional view of a part of the door lock system.

The door lock system is disposed within a door of the vehicle, and is formed to accommodate a first link mechanism 20 and a second link mechanism 30 in a housing 10 (see FIG. 4). The housing 10 comprises a main body 11, a first cover 12 and a second cover 13. The main body 11 includes a) a first casing portion 11*a* (see FIG. 2) which has a dish shape open to the vehicle inside direction and b) a second casing portion 11*b* (see FIG. 2) which has a dish shape perpendicular to the first casing portion 11*a* and which is open to the vehicle back side direction. The first casing portion 11*a* and the second casing portion 11*b* are integrally formed therewith. The first cover 12 is attached to the first casing portion 11*a* at the opening side thereof. The second cover 13 is attached to the second casing portion 11*b* at the opening side thereof. Thus, the opening of the first casing portion 11*a* is closed by the first cover 12, and the opening of the first casing 11*b* is closed by the second cover 13.

In the housing 10, both a) an electric distribution plate 14 which is electrically connected to an electric motor 25 acting as an actuator and b) structural members of the first link mechanism 20 are disposed so as to be accommodated between the first casing portion 11*a* and the first cover 12. A sub base plate 15 and structural members of the second link mechanism 30 are accommodated between the second casing portion 11*b* and the second cover 13. A base plate 16 is attached to the second cover 13 at an opening side thereof. Thus, the opening of the second cover 13 is closed and covered by the base plate 16. Each structural member of a latch mechanism 40 is accommodated between the inside of the second cover 13 and the base plate 16.

Figure 8:
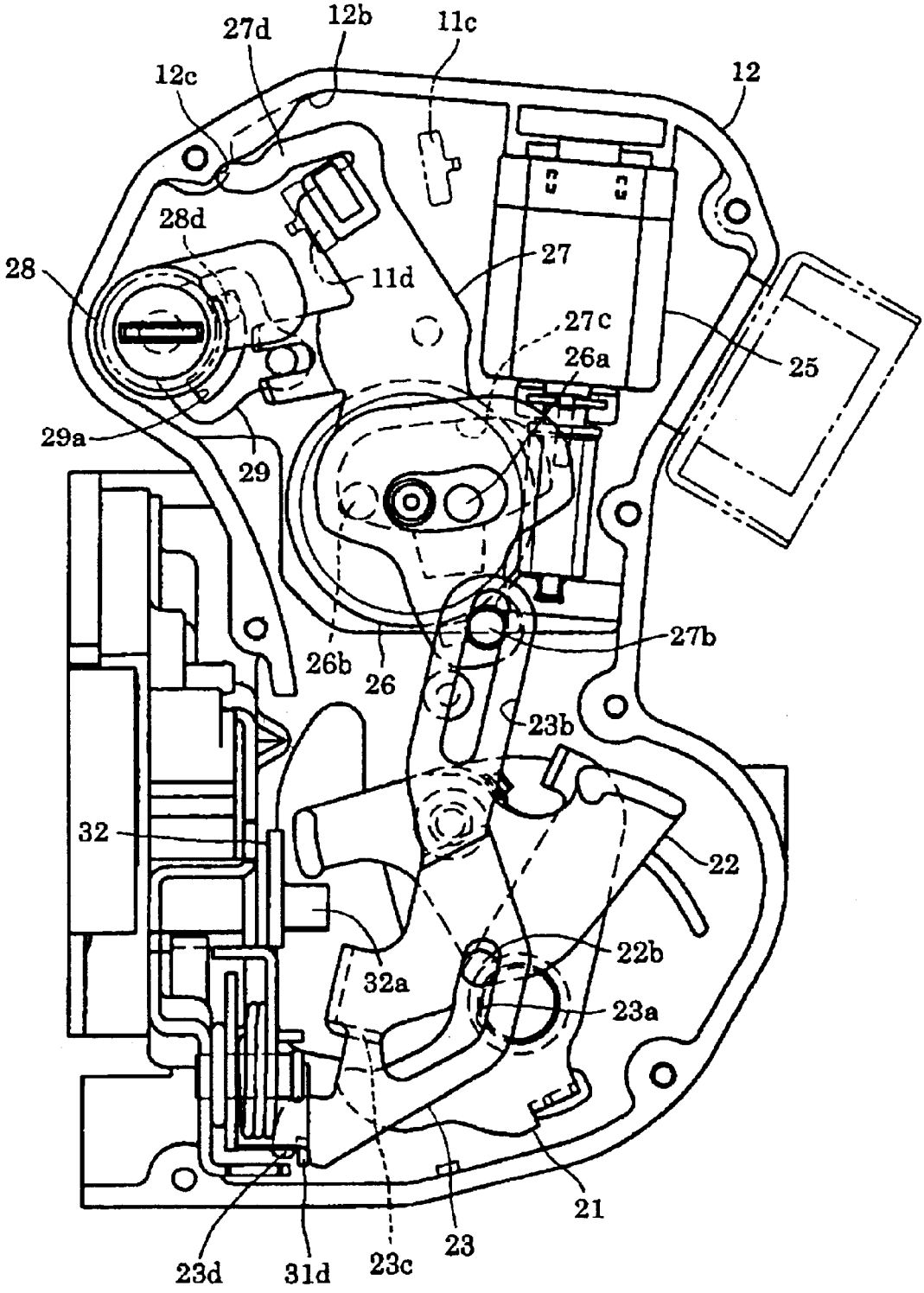
FIG. 8 shows a side view of an inside of the door lock system in an locked state.
Figure 9:
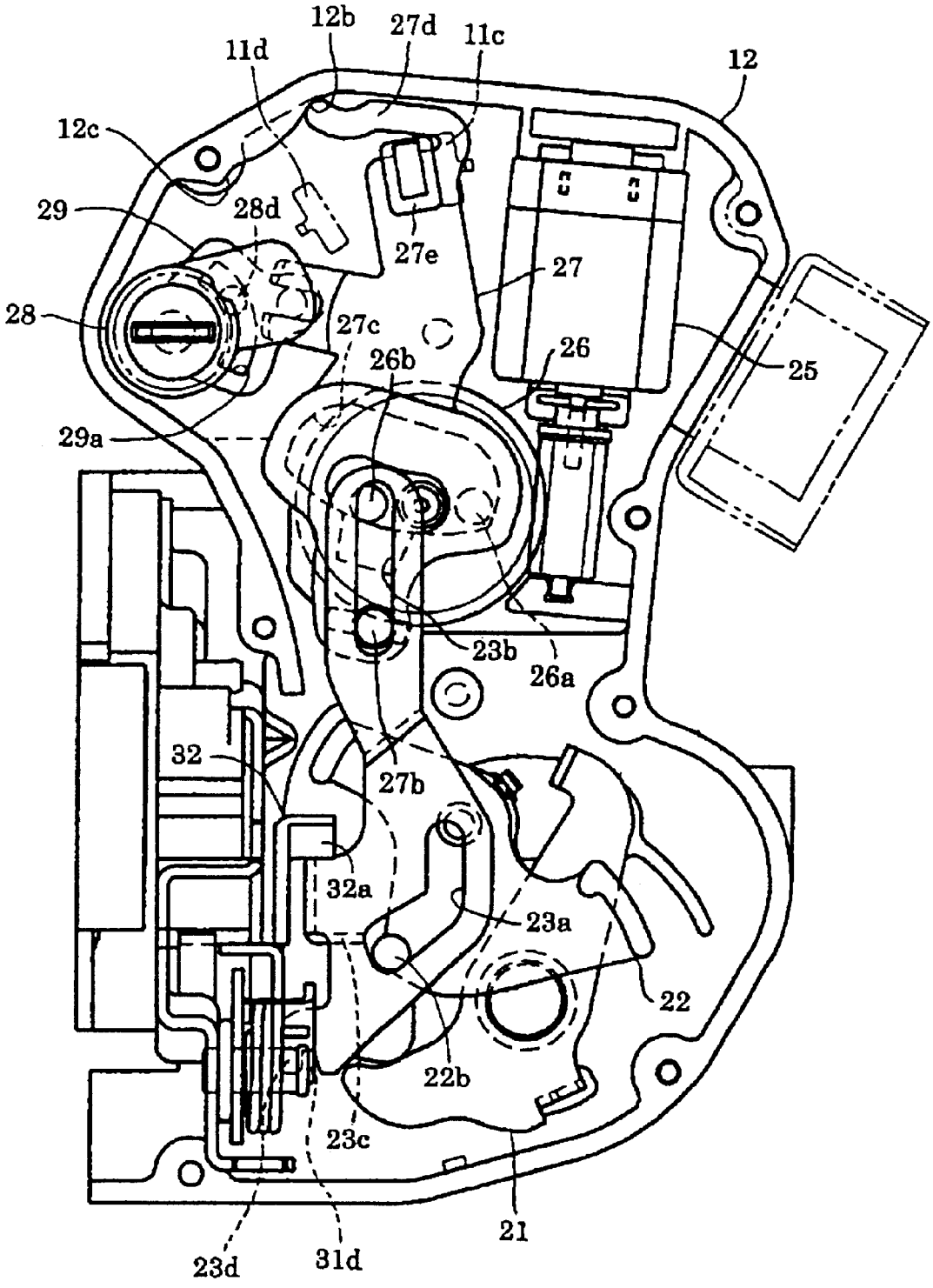
FIG. 9 shows a side view of the inside of the door lock system which is in the unlocked state when an outside handle is operated.

A first inside lever 21 is rotatably supported on the inside of the first cover 12 by a supporting pin 21*a* (see FIG. 2) so as to be rotatably movable in vertical and longitudinal directions of the vehicle. A second inside lever 51 is rotatably supported on the outside of the first cover 12 by the supporting pin 21*a* so as to be rotatably movable in vertical and longitudinal directions of the vehicle. The first inside lever 21 has an engaging projection 21*b* (see FIG. 2) which extends in the vehicle inside direction through a sector-shaped hole 12*a* formed in the first cover 12. The engaging portion 21*b* of the first inside lever 21 engages with a connecting hole 51*a,* whereby the engaging projection 21*b* connects the first inside lever to the second inside lever 51 as one unit. The first inside lever 21 has an engaging projection 21*c* which extends in the vehicle outside direction. When the first inside lever 21 is rotated in a clockwise direction as shown in FIG. 8, the engaging projection 21*c* engages with a canceling lever 22. The canceling lever 22 is then rotated.

Figure 1:
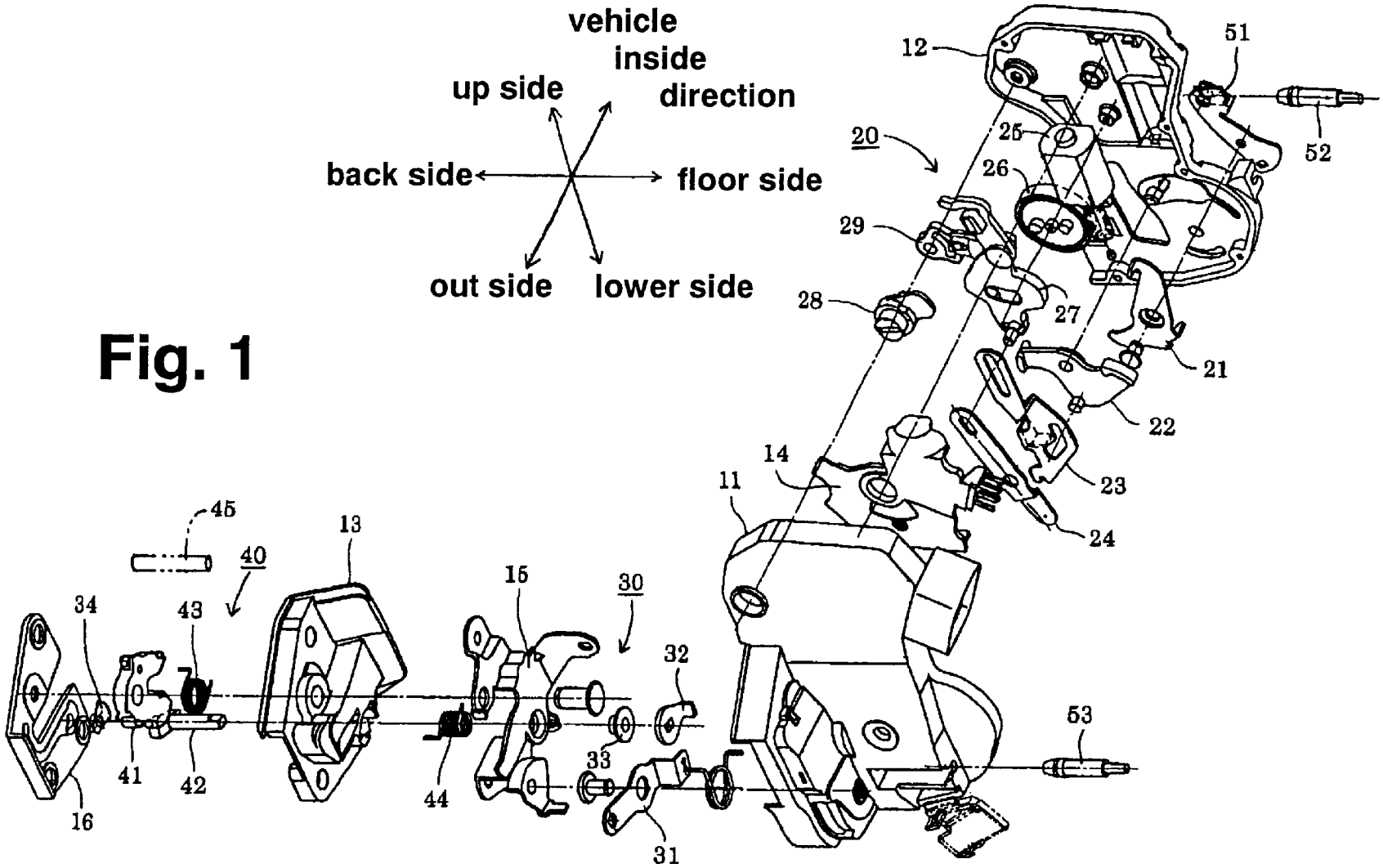
FIG. 1 shows an exploded perspective view of a door lock device of an embodiment of this invention.
Figure 2:
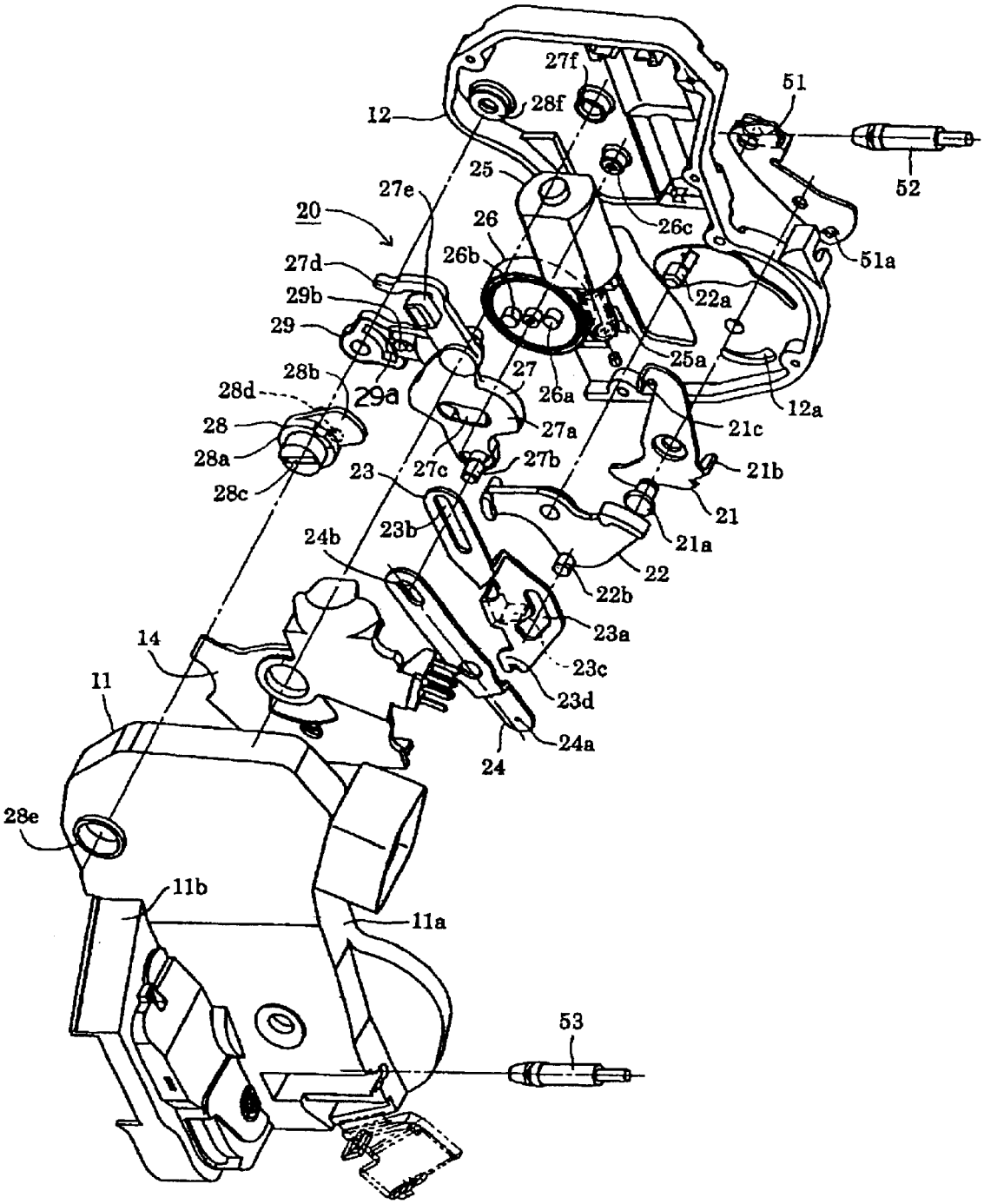
FIG. 2 shows an enlarged perspective view of one part of FIG. 1.
Figure 7:
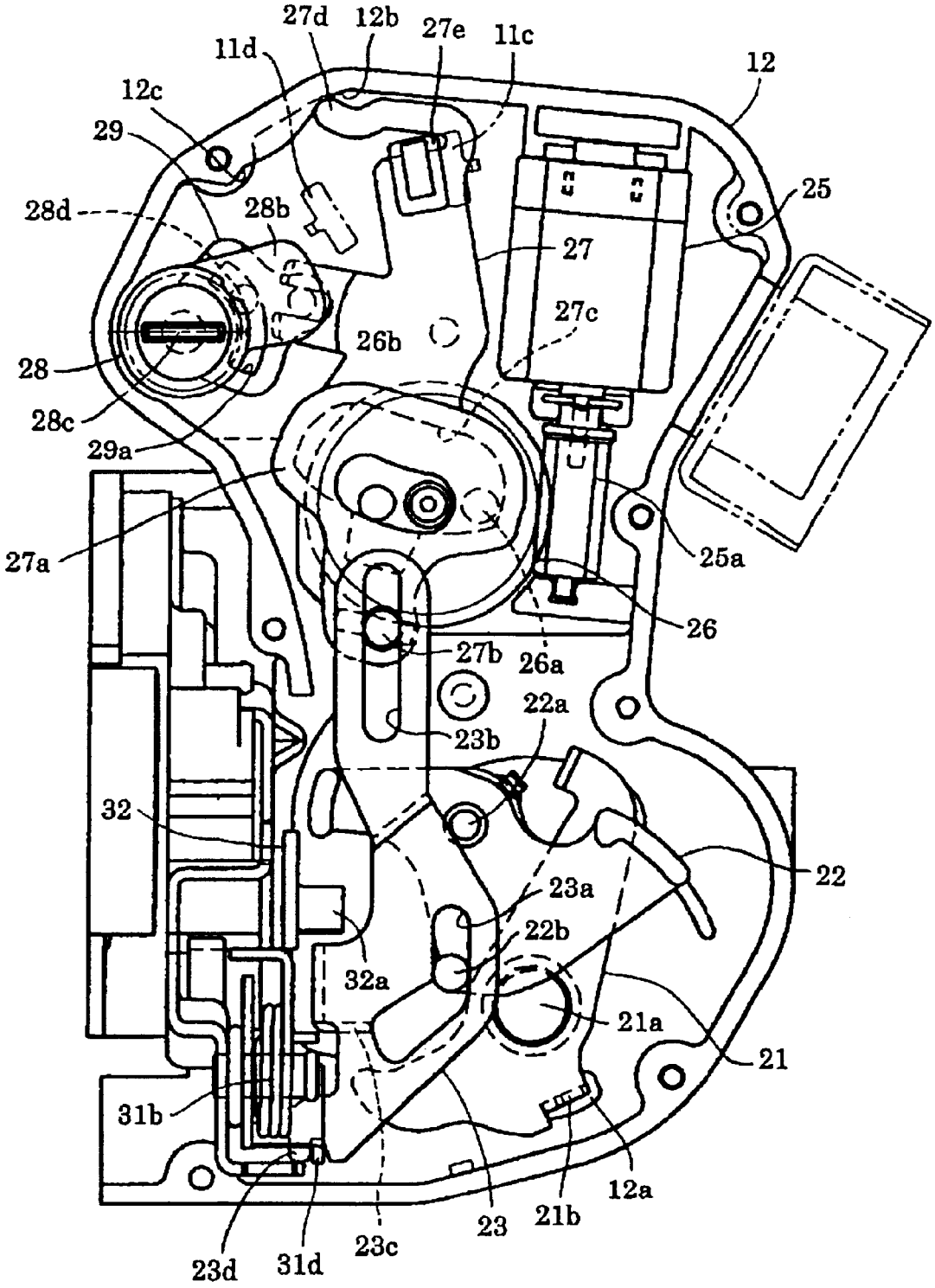
FIG. 7 shows a side view of structural members of the door lock system in an unlocked stage.

The second inside lever 51 is connected with an inside cable 52 which is connected with an inside handle (not shown) disposed inside of the vehicle. The rotation of the inside handle in a door opening direction (the operation for opening the door using the inside handle) causes the second inside lever 51 to rotate in a clockwise-direction as indicated in FIG. 1, FIG. 2 and FIG.7, thereby rotating the first inside lever 21 in the same direction.

The canceling lever 22 is rotatably supported at the inside of the first cover 12 by a supporting pin 22*a* formed integrally with the first cover 12. The canceling lever 22 is provided adjacent the first inside lever 21 in the vehicle outside direction to be parallel to the first inside lever 21. The canceling lever 22 has an engaging pin 22*b* which extends in the vehicle outside direction. The engaging pin 22*b* is inserted into a first engaging groove 23*a* which is formed as a V-shaped slot. The groove 23*a* is formed in an open link 23 which is disposed adjacent the canceling lever 22 in the vehicle outside direction.

The open link 23 has an elongated second engaging groove 23*b* wherein an engaging pin 27*b* of an active lever 27 is inserted. An engaging portion 23*c,* which is formed as a L-shaped plate, engages with an end of the first inside lever 21. A connecting portion 23*d* connects the open link 23 to an opening lever 31. The open link 23 is supported by the canceling lever 22, the active lever 27 and the opening lever 31.

The locking lever 24 is rotatably supported on an inside of the first casing portion 11*a* by a supporting pin 24*c* (FIG. 4) formed integrally with the main body 11 to be rotatably movable in the vertical and longitudinal directions of the vehicle. The locking lever 24 is provided in parallel with the open link 23. The locking lever 24 has an attachment hole 24*a* which is fixed to a locking cable 53. An elongated engaging groove 24*b* has inserted therein an engaging pin 27*b* of the active lever 27. The locking cable 53 is connected with a locking knob (not shown) which is disposed on an inside of a door of the vehicle. When the locking knob is operated for locking the door, the locking cable 53 transmits an operation force from the locking knob to the locking lever 24, thereby rotating the locking lever 24 in the clockwise direction as shown in FIG. 1.

The electric motor 25 generates the operation force for moving the first link mechanism 20. The electric motor 25 is attached to the inside of the first cover 12. The electric motor 25 includes a worm gear 25*a* at an output shaft of the electric motor 25. The worm gear 25*a* is in mesh engagement with a wheel gear 26. The wheel gear 26 has a pair of engaging pins 26*a,* 26*b* on an outside thereof. The wheel gear 26 is rotatably supported on the inside of the first cover 12 by a supporting boss 26*c* formed integrally with the first cover 12. Both engaging pins 26*a* and 26*b* are arranged at both sides of the rotational center of the wheel 26 in the longitudinal direction of the vehicle such that a predetermined space is defined between engaging pins 26*a* and 26*b*. Either engaging pin 26*a* or 26*b* extends into an engaging concave portion 27*c* of the active lever 27.

The active lever 27 is disposed between the wheel gear 26 and the open link 23. The active lever 27 is rotatably supported on the inside of the first cover 12 by a supporting boss 27*f* formed integrally with the first cover 12. The active lever 27 includes a main lever portion 27*a,* a projecting portion 27*d* having a spring function and a rubber cushion 27*e*. The main lever portion 27*a* has the engaging pin 27*b* projecting in the vehicle outside direction and an engaging concave portion 27*c* opening in a vehicle inside direction. The projecting portion 27*d* is provided at an upper end of the main lever portion 27*a*. The rubber cushion 27*e* is disposed on the portion between the main lever portion 27*a* and the projecting portion 27*d*. The engaging pin 27*b* of the active lever 27 extends through the second engaging groove 23*b* of the open link 23 and the engaging groove 24*b* of the locking lever 24. The engaging concave portion 27*c* of the active lever 27 has either engaging pins 26*a* or 26*b* extending thereinto. An end of the projecting portion 27*d* of the active lever 27 elastically contacts an inner periphery of the first cover 12. The engaging concave portion 27*c* of the active lever 27 is formed so that either the front engaging pin 26*a* or the rear engaging pin 26*b* can be engaged with the active lever 27 when the wheel gear 26 is rotated in either the normal or the reverse directions. The active layer 27 can be rotated in either the clockwise direction or the counter-clockwise direction as shown in FIGS. 7 and 8. The end of the projecting portion 27*d* slidably moves on the inner periphery of the first cover 12 and selectively engages with either of these engaging concave portions 12*b* or 12*c* (FIG. 7). The rubber cushion 27*e* selectively contacts either stopper portions 11*c* or 11*d* in accordance with the above motion of the projecting portion 27*d*.

A key lever 28 has a cylinder-shaped main body 28*a* and a lever portion 28*b* formed integrally with the cylinder-shaped main body 28*a*. The key lever 28 and an idle lever 29 are rotatably supported by a supporting boss 28*e* (see FIG. 2) formed integrally with the first casing portion 11*a* and a supporting boss 28*f* formed integrally with the first cover 12. The key lever 28 has an engaging groove 28*c* provided in the main body 28*a* and an engaging pin 28*d* provided on the lever portion 28*b* at the opposite side thereof (FIG. 2). An end of a projecting pin of a key cylinder (not shown), which is disposed on the outside of the door, is disposed into the engaging groove 28*c*. The engaging pin 28*d* extends into a sector-shaped engaging groove 29*a* formed in the idle lever 29. The key lever 28 is rotated by the rotation of the key cylinder turned by a key (not shown). The key lever 28 rotates the idle lever 29 via the engaging pin 28*d*. Then, the idle lever 29 selectively rotates the active lever 27 in the clockwise direction or the counter-clockwise direction (as indicated in FIGS. 7 and 8) via a connecting pin 29*b* formed integrally with the idle lever 29.

Figure 3:
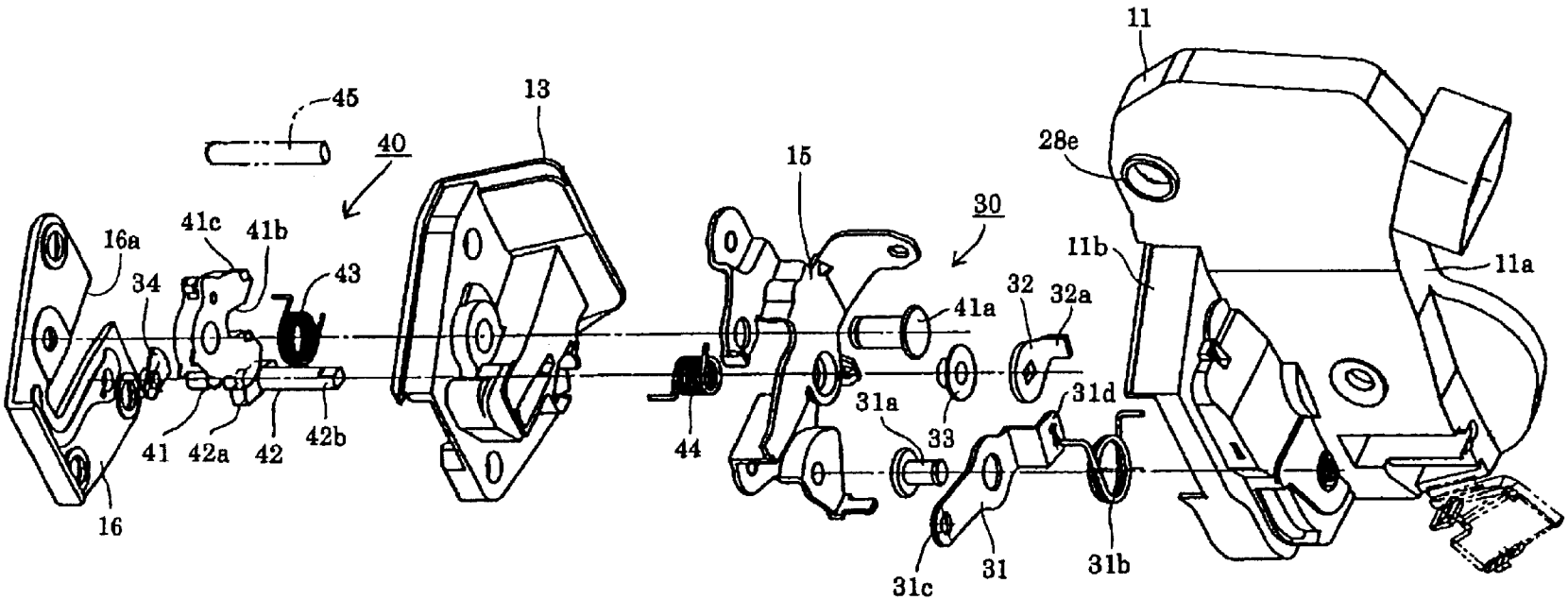
FIG. 3 shows an enlarged perspective view of the other part of FIG. 1.

Each structural member of the second link mechanism 30 is accommodated between the second casing portion 11*b* of the main body 11 and the second cover 13 as shown in FIG. 3. The opening lever 31 of the second link mechanism 30 is rotatably supported on the second casing portion 11*b* and the sub base plate 15 by a supporting pin 31*a* via a torsion spring 31*b*. The opening lever 31 is rotatably movable in vertical and width directions of the vehicle between the second casing portion 11*b* and the sub base plate 15. A rotating end 31*c* of the opening lever 31 is connected with an outside link. The outside link is connected to an outside handle (not shown) which is disposed on the outside of the door. The opening lever 31 is rotated in a counter-clockwise direction as indicated in FIG. 4 against the force of the torsion spring 31*b* by the operation of the outside handle in a door opening direction (the operation for opening the door using the outside handle). A lifting lever 32 is disposed on a periphery of a shaft 42*b* for unitary rotation therewith. The shaft 42*b* is extended through the second cover 13 via a bush 33. An engaging portion 32*a,* formed on periphery of the lifting lever 32, is extended above the upper end of the engaging portion 23*c* of the open link 23.

Figure 5:
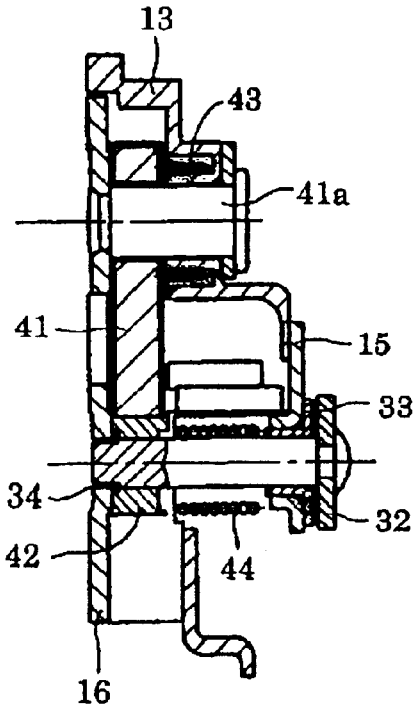
FIG. 5 shows a vertical cross-sectional view of FIG. 4 taken along the lines V—V.
Figure 6:
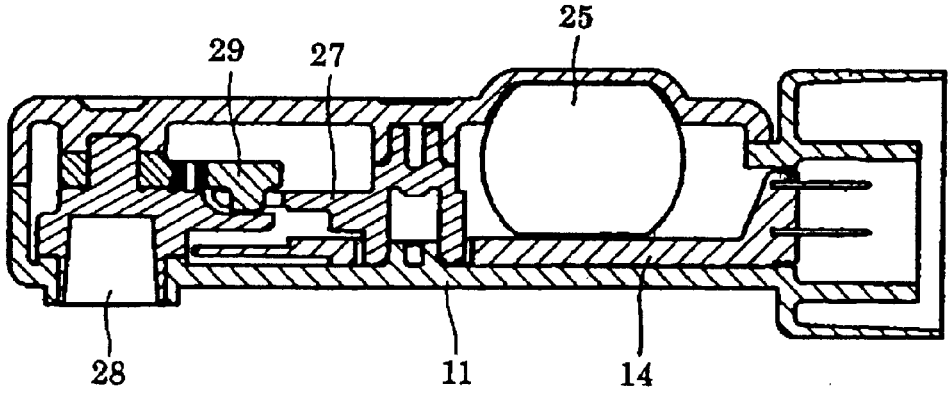
FIG. 6 shows a horizontal cross-sectional view of FIG. 4 taken along the lines the lines VI—VI.

The latch mechanism 40 includes a latch 41, a pawl 42, a pair of torsion springs 43 and 44 applying spring forces to the latch 41 and the pawl 42, respectively. The latch 41 is rotatably supported between the second cover 13 and the base plate 16 by a supporting pin 41*a.* The supporting pin 41*a,* extending through the sub base plate 15, the second cover 13 and the base plate 16, is supported by both the second cover 13 and the base plate 16. One end of the torsion spring 43, which is provided on the supporting pin 41*a,* is engaged with the latch 41. The other end of the torsion spring 43 is engaged on the second cover 13. The torsion spring 43 applies the predetermined spring force to the latch 41 for regulating the rotation of the latch 41 so that the latch 41 can be returned to its initial position by the spring force when the latch 41 is rotated to be out of an initial position thereof. The latch 41 is held by the torsion spring 43 so that an opening of a latch groove 41*b* can substantially coincide with an opening of an insertion groove 16*a* formed in the base plate 16. The pawl 42 includes a block-like main pawl body 42*a* and a shaft 42*b* extending approximately perpendicular to the main pawl body 42*a.* The shaft 42*b* extends into the second casing portion 11*b* through the second cover 13 and the sub base plate 15 via the bush 33. The shaft 42*b* is rotatably supported by the sub base plate 15 via the bush 33. The shaft 42*b* is further rotatably supported by the base plate 16 via the bush 34. The torsion spring 44 is provided on the shaft 42*b* at the middle portion between the main pawl body 42*a* and sub base plate 15. The lifting lever 32 is rigidly connected to one end of the shaft 42*b* for unitary rotation therewith (after the torsion spring 44 is provided on the shaft 42*b,* the end of shaft 42*b* is disposed into the lifting lever 32 and formed with a head by riveting as shown in FIG. 5). One end of the torsion spring 44 is engaged with the pawl 42. The other end of the torsion spring 44 is engaged with the sub base plate 15. The torsion spring 44 applies a predetermined spring force to the shaft 42*b* for regulating the rotation of the shaft 42*b* so that the pawl 42 can be returned to its initial position by the spring force when the pawl 42 is rotated. The pawl 42 causes the main pawl body 42*a* to contact the periphery of the latch 41.

When a striker 45, which is mounted on a body of the vehicle, moves relatively into the latch 41 through the insertion groove 16*a,* the latch 41 is rotated by the pressure from the striker 45 against the spring force of the torsion spring 43. The latch 41 then receives the striker 45. While the latch 41 receives the striker 45, the pawl 42 slidably contacts on the outer periphery of the latch 41. The pawl 42 moves into a latch portion 41*c* to be engaged thereon. The pawl 42 holds the latch 41 which has been rotated to receive the striker 45. Thus, the pawl 42 keeps the latch 41 engaged with the striker 45. Under the above state, the door of the vehicle is closed. Under the above engagement state, the latch 41 is returned to an initial position thereof by the force of the torsion spring 43. When the pawl 42 is rotated to be moved away from the latch portion 41*c* by the rotation of the lifting lever 32, while the latch 41 is returned by the spring force of the torsion spring 43, the opening of the latch groove 41*b* is rotated to match the opening direction of the insertion groove 16*a.* Under the above state, the striker 45 can be moved away from the latch groove 41*b* and the opening of the insertion groove 16*a* of the base plate 16. The door of the vehicle can then be opened.

The pawl 42 functions for selectively holding between the engaging condition in which the latch 41 engages with the striker 45 and the disengaging condition in which the latch 41 disengages from the striker 45. When the pawl 42 is rotated against the spring force of the torsion spring 44, the pawl 42 is moved away from the latch portion 41*c* of the latch 41. The pawl 42 then changes to the disengaging condition between the latch 41 and the striker 45 from the engaging condition between the latch 41 and the striker 45.

The operation modes of the door lock system consists of the operation modes causing the door lock system be in the unlocked state capable of releasing the engagement between the latch 41 and the striker 45, the operation modes causing the door lock system be in the locked state incapable of releasing the engagement between the latch 41 and the striker 45, and the operation modes causing the door to open or to close when the door lock system is in the unlocked state. The eight operation modes will be described as follows.

First operation mode: The door is opened by operating the inside handle disposed on the inside of the vehicle when the door lock system is in the unlocked state as viewed in FIG. 7. In the door lock system, when the inside handle is operated to open the door, the second inside lever 51 is rotated in a clockwise direction (as indicated in FIG. 1) via the inside cable 52. The first inside lever 21 is rotated by the second inside lever 51 in a clockwise direction (as indicated in FIG. 7). When the first inside lever 21 is rotated in the clockwise direction (as indicated in FIG. 7), the end of the inside lever 21 engages with the lower surface of the engaging portion 23*c* of the open link 23 and pushes up the open link 23. The open link 23 causes the upper periphery of the engaging portion 23*c* to engage with the engaging portion 32*a* of the lifting lever 32. The lifting lever 32 is then rotated by the open link 23. The pawl 42 is rotated by the lifting lever 32 to be moved away from the latch portion 41*c* of the latch 41. Namely, a regulation of the rotation of the latch 41 by the engagement with the main pawl body 42*a* is released. Thus, the latch 41 is returned to its initial position by the spring force of the torsion spring 43. When the latch 41 is separated from the striker 45 by a force of the door opening, the latch 41 releases the striker 45. Then, the latch 41 is separated from the striker 45. Thus the engagement between the latch 41 and the striker 45 is released by operating the inside handle to open the door. The door can then be opened.

Second operation mode: The door is opened by operating the outside handle disposed on the outside of the vehicle when the door lock system is in the unlocked state as viewed in FIG. 7. In the door lock system, when the outside handle is operated to open the door, the opening lever 31 is rotated against the torsion spring 31*b.* The open link 23 is then pushed up by the opening lever 31. The open link 23 causes the upper periphery of the engaging portion 23*c* to engage with the engaging portion 32*a.* The lifting lever 32 is then rotated by the open link 23. The lifting lever 32 rotates the pawl 42 to be separated from the latch portion 41*c* of the latch 41. Namely, a regulation of the rotation of the latch 41 by the engagement with the main pawl body 42*a* is released. Thus, the latch 41 is returned to its initial position by the spring force of the torsion spring 43. When the latch 41 is separated from the striker 45 by a force of the door opening, the latch 41 releases the striker 45. Then, the latch 41 is separated from the striker 45. Thus the engagement between the latch 41 and the striker 45 is released by operating the outside handle to open the door. The door can then be opened.

In the first and second operation modes, when the open link 23 is pushed up by the opening lever 31 or the first inside lever 21, the canceling lever 22 is rotated in the counterclockwise direction as shown in FIG. 7 by the engagement between the first engaging groove 23*a* of the open link 23 and engaging pin 22*b* of the canceling lever 22.

Figure 10:
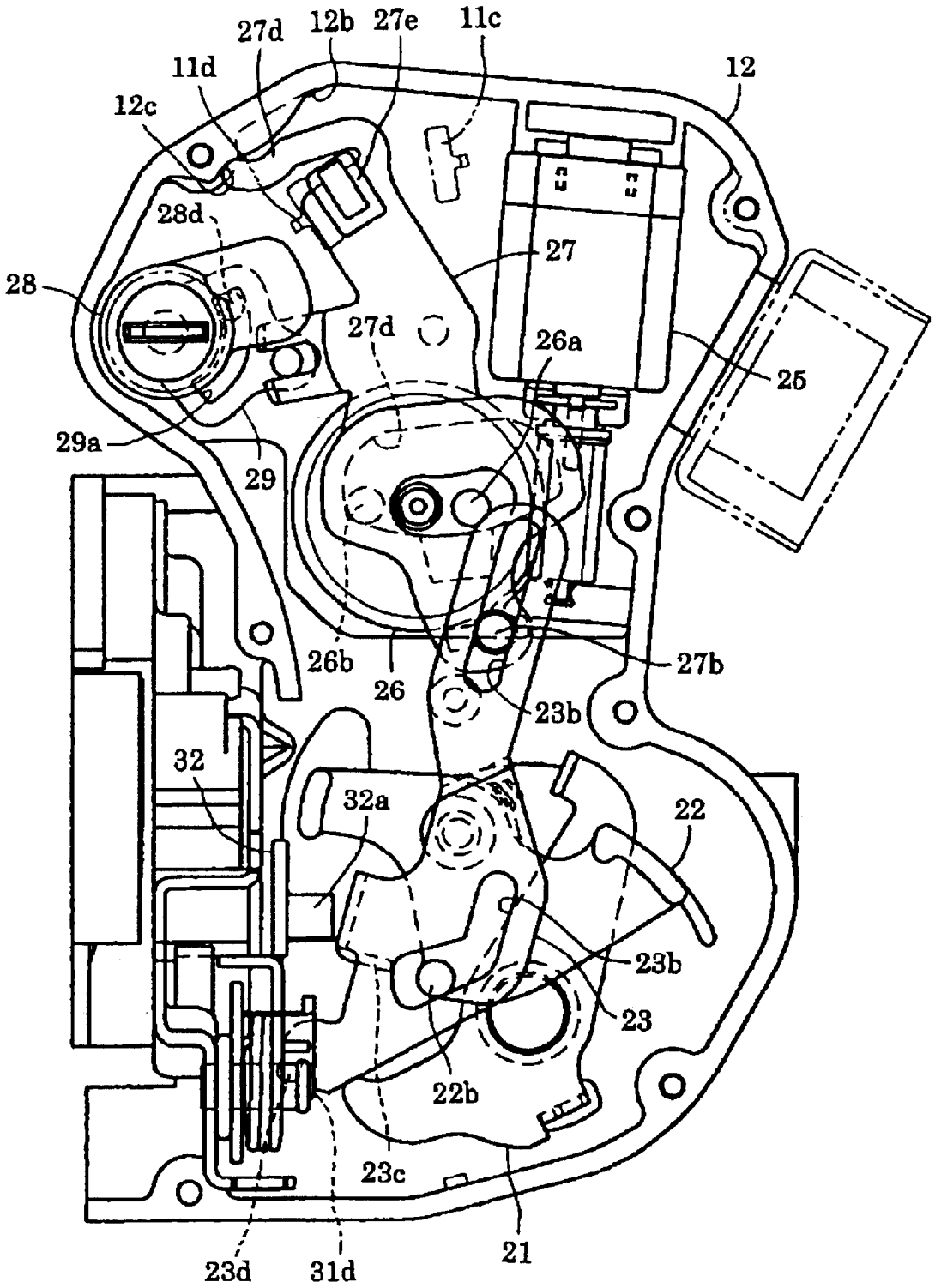
FIG. 10 shows a side view of the inside of the door lock system in a locked state when the inside or outside handle is operated.

Third operation mode: The door lock system, by operating the locking knob inside the vehicle, is brought into the locked state such that the engagement between latch 41 and the striker 45 is impossible. When the door lock system is in the unlocked state as viewed in FIG. 7, the locking cable 53 is moved by operating the locking knob. The locking lever 24 is rotated, and then the active lever 27 is rotated in the counterclockwise direction as shown in FIG. 7. Thus the active lever 27 causes the open link 23 to rotate about the connecting portion between the open link 23 and the opening lever 31 by the engagement between the second engaging groove 23*b* and the engaging pin 27*b*. The open link 23 is thereby shifted from the unlocking position shown in FIG. 7 to the locking position shown in FIG. 8. The unlocking position is the position for the open link 23 which causes the door lock system to be in the unlocked state. The lock position is the position for the open link 23 which causes the door lock system to be in the locked state. Even if the open link 23 is moved as viewed in FIG. 10 by operating the outside handle, the open link 23 fails to engage with the lifting lever 32, whereby the lift lever 32 and the pawl 42 are not rotated. Thus, even if the outside handle is operated for opening the door, the unlocked state for releasing the engagement between the latch 41 and the striker 45 is not established. Thus, the locked state remains, and the door can not be opened. When the open link 23 is moved from the unlocking position shown in FIG. 7 to the locking position shown in FIG. 8, the canceling lever 22 is rotated in the counterclockwise direction shown in FIG. 8 by the engagement between the first engaging groove 23*a* of the open link 23 and the engaging pin 22*b*.

Fourth operation mode: The door lock system is brought into either the locked state or the unlocked state by a key operated rotation of the key cylinder from outside of the vehicle. In the door lock system, when the key cylinder is rotated by the key, the key lever 28 is rotated. The active lever 27 is then selectively rotated by the key lever 28 via the idle lever 29 to be in either the position shown in FIG. 7 or the position shown in FIG. 8. The open link 23 is selectively moved by the active lever 27 to be in the unlocking position shown in FIG. 7 or the locking position shown in FIG. 8 via the engagement between the second engaging groove 23*b* and the engaging pin 27*b*. The rotation of the key cylinder, by manipulating the key, causes the door lock system to be selectively in either a) the unlocked state which is capable of releasing the engagement between the latch 41 and the striker 45 or b) the locked state which is incapable of releasing the engagement.

Fifth operation mode: The door lock system is brought into either the locked state or the unlocked state when the electric motor 25 is remotely-controlled by operating a remote device control, such as a lock-unlock switch which acts as a key, from outside of the vehicle. In the door lock system, when the lock/unlock switch is operated, the electric motor 25 rotates the wheel gear 26 through a predetermined rotation amount via the worm gear 25*a*. When the wheel gear 26 rotates one or the other direction, either of the engaging pins 26*a* or 26*b* selectively engages a part of engaging concave portion 27*c* of the active lever 27. The active lever 27 is then rotated to the position shown in FIG. 7 or the position shown in FIG. 8. Therefore, the open link 23 is selectively moved to the unlocking position shown in FIG. 7 or the locking position shown in FIG. 8 via the engagement between the second engaging groove 23*b* and the engaging pin 27*b*. Thus the operation of the lock/unlock switch causes the door lock system to be selectively in either a) the unlocked state which is capable of releasing the engagement between the latch 41 and the striker 45 by the opening operation of the outside handle or b) the locked state which is incapable releasing the engagement.

Figure 11:
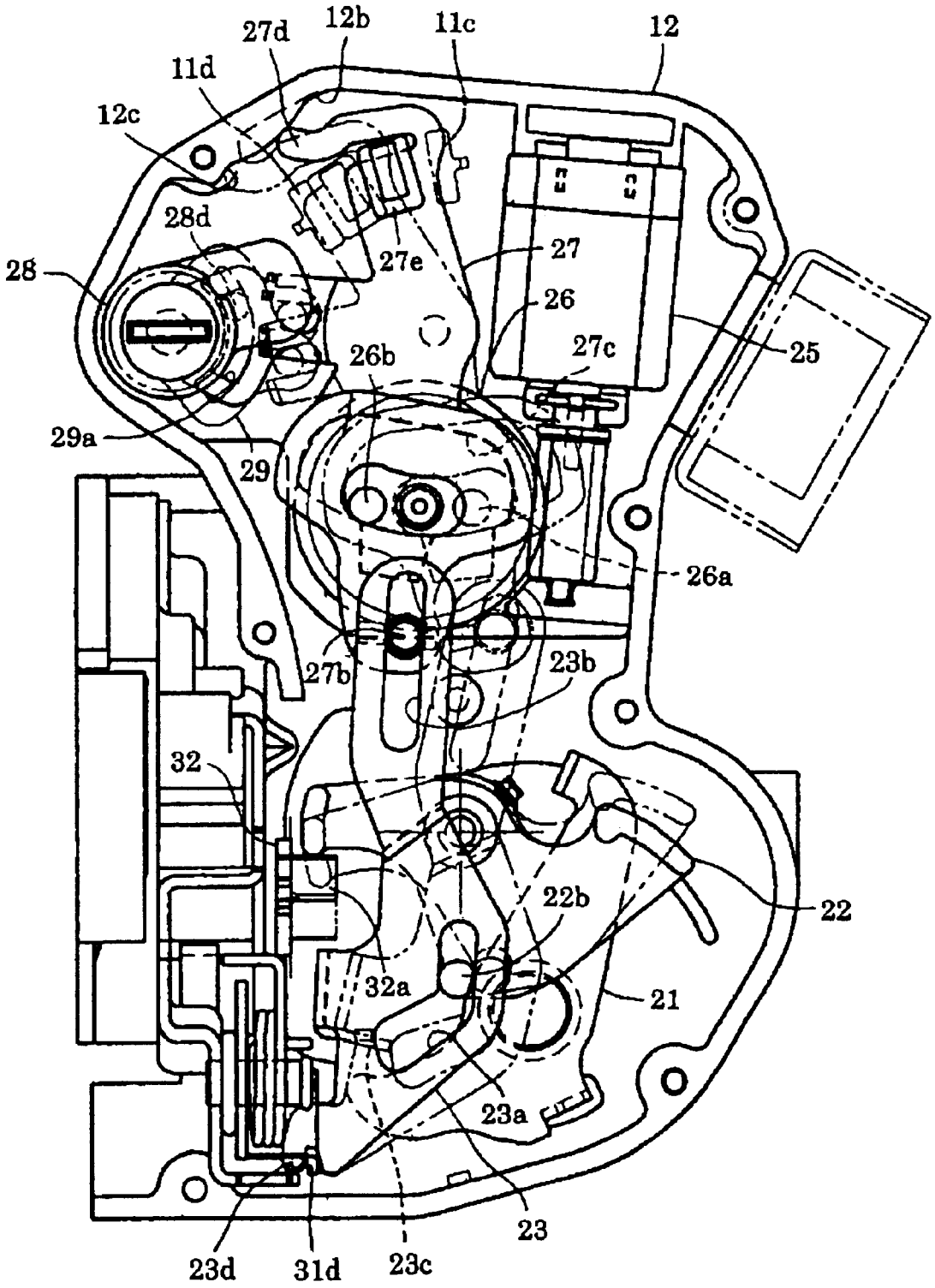
FIG. 11 shows a side view of the inside of the door lock system in a canceling operation.

Sixth operation mode (canceling operation): The door is closed without operating a door handle such as the outside handle or the inside handle after bringing the door lock system into the locked state by a manual operation of the locking knob while the door is open. In the door lock system, as the door is closed, the striker 45 causes the latch 41 to rotate. Accordingly, the pawl 42 rotates by the rotation of the latch 41. Then the lifting lever 32 rotates from the position shown by two-dot-lines in FIG. 11 to the position shown by solid lines in FIG. 11, thereby rotating the canceling lever 22 from the position shown by the two-dot-lines in FIG. 11 to the position shown by the solid lines in FIG. 11. Thus the open link 23 at the locking position shown by the two-dot-lines is moved to the unlocking position shown by the solid lines due to engagement between the first engaging groove 23*a* and the engaging pin 22*b*. In the above process, the door lock system is in the unlocked state capable of releasing the engagement between the latch 41 and the striker 45. The door can then be opened by opening the door using either the outside handle or the inside handle.

Figure 12:
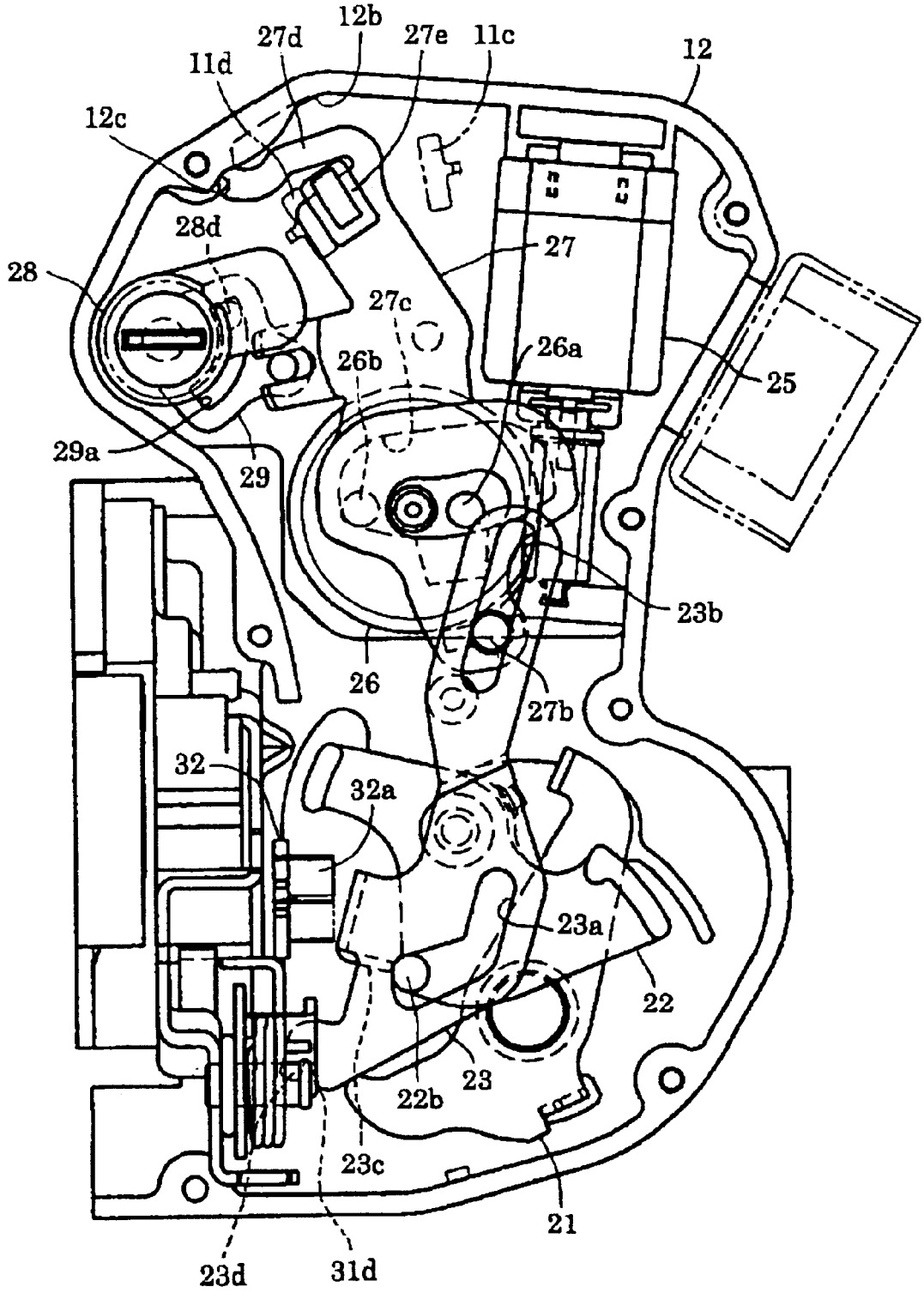
FIG. 12 shows a side view of the inside of the door lock system in a keyless locking operation.

Seventh operation mode (keyless locking operation): The door lock system is brought into the locked state in such a manner that while the door is opened, the locking knob is manually operated to bring the door lock system into the locked state and thereafter the door is closed. In the door lock system, when the outside handle is operated for opening the door while the door lock system is in the locked state, the opening lever 31 is rotated to push the open link 23 up as shown in FIG. 12. Thus, the engaging pin 22*b* of the canceling lever 22 is located at a downside of the first engaging groove 23*a* and is out of engagement with anything. When the door is closed in the above condition, the latch 41 is rotated by the striker 45. Then, the pawl 42 causes the lifting lever 32 to rotate, whereby the canceling lever 22 is rotated in the clockwise direction shown in FIG. 12. However, the engaging pin 22*b* of the canceling lever 22 is located in the first engaging groove 23*a* of the open link 23 and is out of engagement with anything, thereby not moving the open link 23 to the unlocking position. The open link 23 is therefore kept in the locking position. Thus, the door lock system can be in the locked state which is capable of releasing the engagement between the latch 41 and the striker 45 when the door is closed. In addition, if the door opening operation by the outside handle is interrupted after closing the door, the condition as shown in FIG. 12 is changed to the condition as shown in FIG. 8, whereby the door lock system remains in the locked state.

Figure 13:
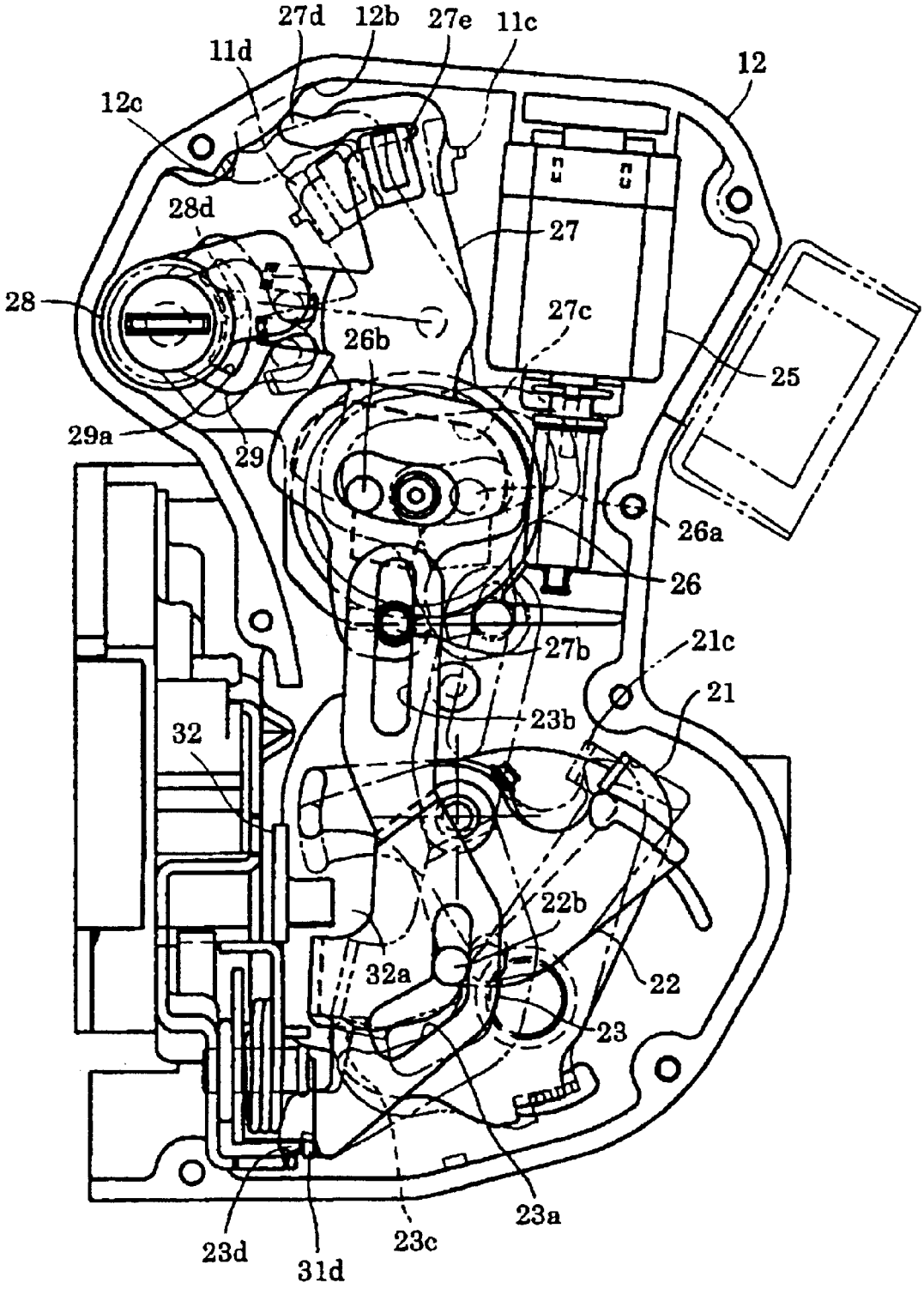
FIG. 13 shows a side view of the inside of the door lock system in a one-motion operation.

Eighth operation mode (one motion operation): In succession, the locked state of the door lock system is cancelled and the door is opened by opening the door using the inside handle when the door lock system is in the locked state which is capable releasing the engagement between the latch 41 and the striker 45. In the door lock system, when the inside handle is operated for opening the door, the second inside lever 51 and the first inside lever 21 are rotated as one unit. Then, the engaging projection 21*c* of the first inside lever 21 rotates the canceling lever 22, which causes the open link 23 to move from the locking position shown by the two-dot-lines in FIG. 13 to the unlocking position shown by the solid lines in FIG. 11 by the engagement between the first engaging groove 23*a* and the engaging pin 22*b*. The active lever 27 and the idling lever 29 are then moved from the locking position shown by the two-dot-lines in FIG. 13 to the unlocking position indicated by the solid lines in FIG. 11 by the engagement between the second engaging groove 23*b* and the engaging pin 27*b*. The open link 23 is thus pushed up by the first inside lever 21, thereby causing the lifting lever 32 and the pawl 42 to rotate. Thereafter the door can be opened.

All members of the first link mechanism 20 and the second link mechanism 30 of the door lock system are accommodated within the housing 10. No members of these link mechanisms 20, 30 can be placed outside the housing 10. Thus each member of both the first link mechanism 20 and the second link mechanism 30 can not be operated from outside of the door through the gap between the door and the body of the vehicle. Therefore, the door lock system can keep the engagement between the latch 41 and the striker 45 thereby preventing the door from opening. In addition, since each member of both the first link mechanism 20 and the second link mechanism 30 is not exposed outside the housing 10, each of the members absolutely can not be exposed to water which enters the door.

For a one motion operation, wherein the inside handle is operated for opening the vehicle door when the engagement of the latch mechanism 40 is in the locked state which is incapable of releasing the engagement between the latch 41 and the striker 45, the first inside lever 21 transmits the operation force from the inside handle to the canceling lever 22 thereby rotating the canceling lever 22. The canceling operation (rotation of the open link 23) is therefore achieved, and the active lever 27 is rotated with the idle lever 29. After the above operation, the first insider lever 21 pushes the open link 23 up without engaging both the active lever 27 and the idle lever 29, whereby the opening operation is accomplished.

In the one motion operation, the canceling operation and the opening operation are respectively achieved by using the canceling lever 22, and by using the set of the active lever 27, the idle lever 29 and the open link 23, separately. During the one motion operation, the operation force generated by opening the door using the inside handle is separately transmitted to different functional members, respectively. Thus a momentary large operation force is not necessary for opening the door using the inside handle.

The principles of the preferred embodiment described herein is therefore illustrative and not restrictive, the scope of the invention being indicated in the appended claims and all variations which come within the spirit and meaning of the claims are intended be embraced therein.

What we claimed is:

1. A door lock system for a vehicle comprising:

a latch mechanism adapted to be mounted on a vehicle door to latch the vehicle door to a vehicle body;

an open link engageable and disengageable with the latch mechanism;

an inside lever adapted to be connected to an inside handle of the vehicle door and engageable with the open link; and a cancel lever connected to the open link and arranged between the inside lever and the open link, wherein when the open link is disengaged from the latch mechanism and the inside lever is moved through operation of the inside handle, the inside lever is first engageable with and moves the cancel lever to move the open link to a position for engaging the latch mechanism and then the inside lever is engageable with and moves the open link to engage the latch mechanism to open the vehicle door.

2. A door lock system for a vehicle according to claim 1, further comprising:

a housing accommodating the open link, the inside lever and the cancel lever, wherein the inside lever and the cancel lever are rotatably supported in the housing.

3. A door lock system for a vehicle according to claim 2, further comprising:

an opening lever perpendicularly arranged relative to the open link and rotatably supporting the open link;

a slot formed in the open link; and a pin formed on the cancel lever and inserted into the slot, wherein the open link is rotated by the rotation of the inside lever via the cancel lever.

4. A door lock system for a vehicle according to claim 3, further comprising:

a lifting lever arranged among the latch mechanism, the open link and the cancel lever, wherein the lifting lever is engagable with the cancel lever when the open link is disengaged from the latch mechanism.

5. A door lock system for a vehicle according to claim 1, further comprising:

a lifting lever arranged among the latch mechanism, the open link and the cancel lever, wherein the lifting lever is engageable with the cancel lever when the open link is disengaged from the latch mechanism.

6. A door lock system for a vehicle comprising:

a latch mechanism adapted to be mounted on a vehicle door to latch the vehicle door to a vehicle body;

an open link engageable and disengageable with the latch mechanism;

an inside lever adapted to be connected to an inside handle of the vehicle door and engageable with the open link;

a cancel lever connected to the open link and arranged between the inside lever and the open link, the cancel level being engageable with the inside lever when the open link is disengaged from the latch mechanism;

a housing accommodating the open link, the inside lever and the cancel lever, wherein the inside lever and the cancel lever are rotatably supported in the housing;

an opening lever perpendicularly arranged relative to the open link and rotatably supporting the open link;

a slot formed in the open link; and a pin formed on the cancel lever and inserted into the slot, wherein the open link is rotated by the rotation of the inside lever via the cancel lever.

7. A door lock system for a vehicle according to claim 6, further comprising:

a lifting lever arranged among the latch mechanism, the open link and the cancel lever, wherein the lifting lever is engageable with the cancel lever when the open link is disengaged from the latch mechanism.

8. A door lock system for a vehicle comprising:

a latch mechanism adapted to be mounted on a vehicle door to latch the vehicle door to a vehicle body;

an open link engageable and disengageable with the latch mechanism;

an inside lever adapted to be connected to an inside handle of the vehicle door and engageable with the open link;

a cancel lever connected to the open link and arranged between the inside lever and the open link, the cancel level being engageable with the inside lever when the open link is disengaged from the latch mechanism; and a lifting lever arranged among the latch mechanism, the open link and the cancel lever, wherein the lifting lever is engageable with the cancel lever when the open link is disengaged from the latch mechanism.

9. A door lock system for a vehicle comprising:

a latch mechanism adapted to be mounted on a vehicle door and operable to latch the vehicle door to a vehicle body;

an open link movable between an unlocking position in which movement of the open link effects operation of the latch mechanism to unlatch the vehicle door with respect to the vehicle body and a locking position in which movement of the open link does not effect operation of the latch mechanism to prevent unlatching of the vehicle door with respect to the vehicle body;

an inside lever adapted to be connected to an inside handle of the vehicle door and engageable with the open link; and a cancel lever connected to the open link and arranged between the inside lever and the open link, wherein when the open link is in the locked position and the inside lever is moved by virtue of operation of the inside handle, the inside lever first engages and moves the cancel lever to move the open link to the unlocking position and then engages and moves the open link to effect operation of the latch mechanism.

10. A door lock system for a vehicle according to claim 9, wherein the open link, the inside lever and the cancel lever are accommodated in a housing, with the inside lever and the cancel lever being rotatably supported in the housing.

11. A door lock system for a vehicle according to claim 9, including an opening lever perpendicularly arranged relative to the open link and rotatably supporting the open link.

12. A door lock system for a vehicle according to claim 9, wherein the open link is provided with a slot and the cancel lever includes a pin positioned in the slot, the open link being rotated through rotation of the inside lever via the cancel lever.

13. A door lock system for a vehicle according to claim 9, wherein the latch mechanism includes a latch adapted to receive a striker and a pawl adapted to engage the latch, and a lifting lever which engages a shaft connected to the pawl so that the lifting lever, the shaft and the pawl rotate together.

14. A door lock system for a vehicle comprising:

a latch mechanism adapted to be mounted on a vehicle door and operable to latch the vehicle door to a vehicle body, the latch mechanism comprising a latch and a pawl;

a open link movable with respect to the pawl and the latch to effect operation of the latch mechanism upon movement of the open link when the door lock system is in an unlocked state and to not effect operation of the latch mechanism upon movement of the open link when the door lock system is in a locked state;

an inside lever adapted to be connected to an inside handle of the vehicle door and engageable with the open link; and a cancel lever connected to the open link and arranged between the inside lever and the open link, the cancel level being engageable with the inside lever when the door lock system is in the locked state.

15. A door lock system for a vehicle according to claim 14, wherein the open link, the inside lever and the cancel lever are accommodated in a housing, with the inside lever and the cancel lever being rotatably supported in the housing.

16. A door lock system for a vehicle according to claim 14, including an opening lever perpendicularly arranged relative to the open link and rotatably supporting the open link.

17. A door lock system for a vehicle according to claim 14, wherein the open link is provided with a slot and the cancel lever includes a pin positioned in the slot, the open link being rotated through rotation of the inside lever via the cancel lever.

18. A door lock system for a vehicle according to claim 14, wherein the latch mechanism includes a latch adapted to receive a striker and a pawl adapted to engage the latch, and a lifting lever which engages a shaft connected to the pawl so that the lifting lever, the shaft and the pawl rotate together.

* * * * *